United States Patent [19]

Bostroem

[11] 4,422,403

[45] Dec. 27, 1983

[54] DIPLESS METALLIZING APPARATUS

[76] Inventor: Theodore Bostroem, 470 Park Rd. Ext., Middlebury, Conn. 06762

[21] Appl. No.: 366,312

[22] Filed: Apr. 7, 1982

Related U.S. Application Data

[62] Division of Ser. No. 145,302, Apr. 30, 1980, Pat. No. 4,357,838.

[51] Int. Cl.[3] ..... B05C 11/00

[52] U.S. Cl. ..... 118/63; 118/50; 118/65; 118/67; 118/227; 118/316; 118/405; 118/407; 118/422

[58] Field of Search ..... 118/63, 65, 67, 422, 118/227, 316, 407, 405, 50

[56] References Cited

U.S. PATENT DOCUMENTS

| | | | |
|---|---|---|---|
| Re. 22,605 | 2/1945 | Goff et al. | 118/63 X |
| 2,937,108 | 5/1960 | Toye | 118/65 X |
| 2,970,564 | 2/1961 | Warner | 118/227 X |
| 3,809,570 | 5/1974 | Herman | 427/321 |
| 4,222,342 | 9/1980 | Johansson et al. | 118/407 X |
| 4,231,318 | 11/1980 | Zink | 118/316 X |

*Primary Examiner*—Bernard D. Pianalto

*Attorney, Agent, or Firm*—Schwartz, Jeffery, Schwaab, Mack, Blumenthal & Koch

[57] ABSTRACT

Metallic articles, for instance, ferrous strips are metallized, for instance, zinc coated by passing the heated article through a coating chamber and applying thereto a continuous stream of the molten coating metal so as to uniformly and evenly metallize said article. Thereafter, excess molten coating metal is removed from the coated article by hot gas blasting and the hot gas blasted article leaving the coating chamber is immediately cooled. Wiping means may be provided before applying the molten coating metal so as to deflect any molten coating metal dropping from the metallic article passing therethrough, while rollers may be arranged between the coating metal applying means and the hot gas blasting means. Said rollers serve to remove the major part of excess coating metal from the coated metallic article and to stabilize movement of the metallic article passing through the coating chamber. In contrast to known application of coating metal by atomizing or spraying, no gas is admixed to the continuous stream of the molten coating metal which is, so to say, gently poured onto the surface of the metallic article. Thus coating is effected within a short period of time and a non-porous coating is achieved. Further said short period of time of exposure of the steel article to the liquid zinc enables to eliminate the customary addition of aluminum to the spelter, thus permitting the use of steam for the hot blast instead of the more expensive non-oxidizing gas for that purpose, likewise eliminating the formation of white rust.

11 Claims, 10 Drawing Figures

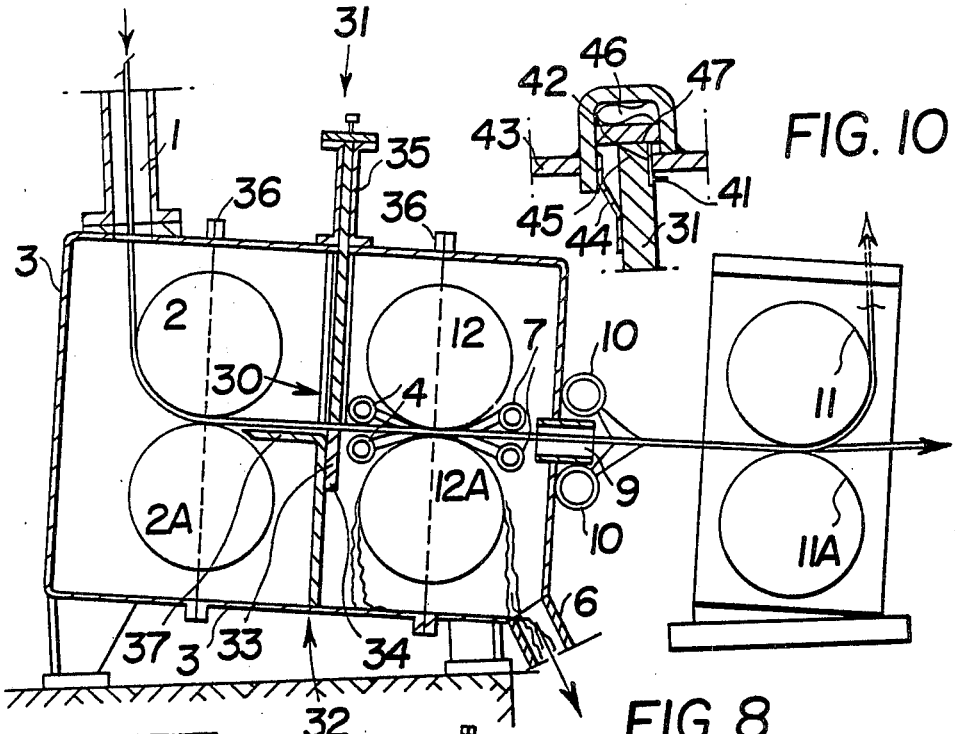
FIG. 10
FIG. 8
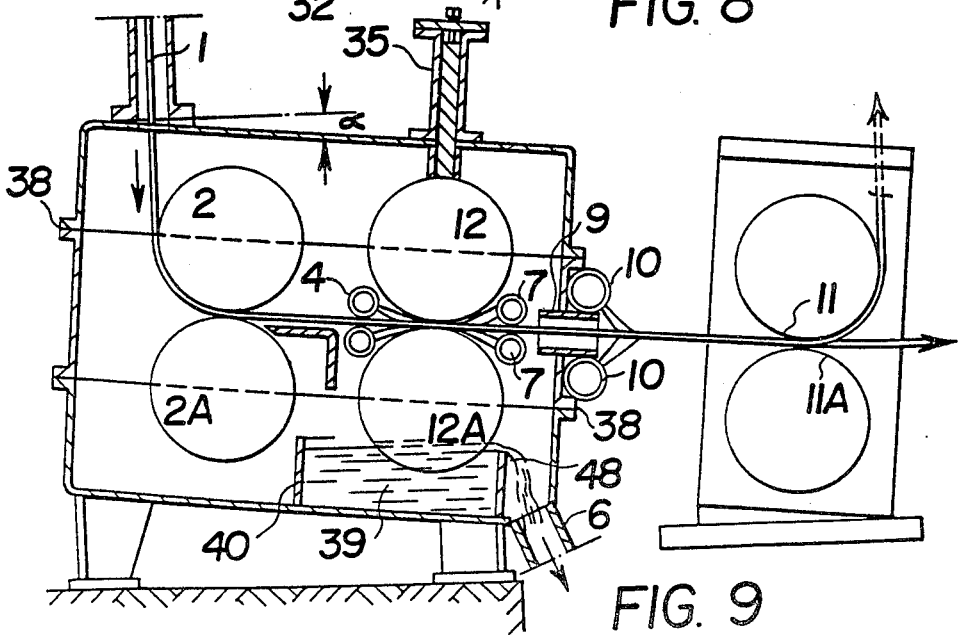
FIG. 9

DIPLESS METALLIZING APPARATUS

This is a division of application Ser. No. 145,302, filed Apr. 30, 1980, U.S. Pat. No. 4,357,838.

BACKGROUND OF THE INVENTION

1. Field of the Invention

The present invention relates to an improved process of providing a metallic article such as a ferrous strip with a coating such as a zinc coating and more particularly to a "dipless" metallizing process without dipping the article into a molten metallizing bath and to an apparatus for carrying out said process.

2. Description of the Prior Art

Modern galvanizing procedures, in spite of recent improvements, can still be considered an outdated inheritance of the original hot dip galvanizing in which the article to be coated was submerged, while still cold, in a heated zinc pot, thereby passing through a layer of a flux which floats on the molten zinc bath and cleans the article to be coated of any dirt and moisture.

Before galvanizing takes place, the article had to be heated to about the melting point of the zinc. Such heating, of course, takes some time. During heating a brittle layer of a ferro-zinc alloy was formed on the interface between the article and the zinc layer. Said ferro-zinc alloy layer caused the zinc coating to readily flake and peel off the article, thus diminishing considerably the anti-corrosive properties of the galvanized article.

In spite of vast improvements as they are achieved by recent modifications of the known processes, the sheet material, usually in the form of a continuous strip, is still passed through a molten zinc bath after it has been preheated and under the protection of a non-oxidizing atmosphere. Thus, it is no longer necessary to keep the strip in the molten zinc in order to heat it. However, on account of merely geometrical considerations, the strip must remain in contact with the molten zinc for a longer period of time than required for purely metallurgical consideration. As a result of such a prolonged contact of strip and zinc a brittle ferro-zinc alloy of greater thickness than desired is formed. Formation of the ferro-zinc alloy is prevented, at least partly, by the addition of aluminum or the like to the zinc bath. Such addition, however, reduces to some extent the ductility of the zinc coating in comparison to the ductility of a non-alloyed zinc coating.

It follows that the duration of contact between the article and the zinc bath is determined by the use of a zinc bath provided with a sinking drum as well as by the dimensions of such a drum.

SUMMARY OF THE INVENTION

It is one object of the present invention to overcome the disadvantages of the heretofore used hot dip galvanizing or other metallizing process and to provide a dipless process whereby contact of the ferrous article with the zinc is of such a short duration that formation of the ferro-zinc alloy layer can be kept under control without having to add aluminum to the spelter.

Another object of the present invention is to provide a simple and effective apparatus to carry out said dipless galvanizing or metallizing process.

A further object of the present invention is to provide a pure zinc coated ferrous strip or article with an intermediate ferro-zinc alloy layer of optimum minimum thickness.

The above and other objects are achieved by the present invention which comprises the instantaneous application of molten metal, i.e. fluid zinc to the heated article, i.e. the hot strip, followed immediately thereafter by exposing the zinc-coated article or strip to the action of a hot, gas blast which removes excess zinc and limits the thickness of the zinc coating. Preferably immediately thereafter the zinc-coated article or strip is rapidly cooled to a temperature below the melting point of the zinc by exposing it to the action of a cooling blast, for instance, by means of jets of a cooling fluid. Portions of the present invention are disclosed but not claimed in U.S. Pat. No. 4,173,663, issued Nov. 6, 1979 to the present inventor.

According to another embodiment of the present invention a pair of rollers is provided between the application of molten zinc to the article and the hot gas blast. These rollers effect better distribution and spreading of the zinc across the entire width of the strip; they will exclude any effect of the hot gas blast on the apparatus and arrangements for applying the zinc to the strip; they will cause considerable stabilization of the moving strip thus resulting in greater efficiency of the hot gas blast arrangements.

The possible geometry of such a process limits the length of contact between ferrous article and zinc to a few inches, compared to several feet as is the case for processes using a zinc bath and a sinking drum. Thus the duration of the iron-zinc contact according to the present invention is several times shorter than that of the conventional methods. In fact the duration of zinc-to-article contact can be limited to less than a second.

As a result thereof, non-alloyed zinc can be used in the process of the present invention thus improving the corrosion resistance of the zinc coating ("pure" metal coating) without undue growth of the brittle intermediate ferro-zinc alloy layer, thus ensuring excellent adherence of the pure zinc coating to the coated article or strip.

Several, but by no means limiting, ways of applying zinc to the strip can be employed. For instance, molten zinc can be poured onto the strip from headers equipped with appropriate nozzles through which molten zinc is discharged upon the strip, for instance, immediately before it is passed between the above mentioned rollers. According to another embodiment of the present invention, the molten zinc is applied to the bodies of the rollers and then applied ("printed") onto the strip as it contacts said rollers. As mentioned above the strip emerging from said rollers undergoes a hot gas blast followed by a rapidly cooling blast outside of the coating chamber. This cooling blast does not have to be non-oxidizing. An air blast or a water spray or the like are adequate means for cooling the coated article. If no aluminum is added to the spelter the hot gas blast does not have to be non-oxidizing either.

In one preferred, but by no means limiting, embodiment of the present invention, the strip emerging from a "snout" of a pretreating device, such as a continuous furnace, is conducted around a pulley and rises to the zone of the metallizing process in a substantially vertical direction. The atmosphere surrounding the pulley is substantially the same as is used in the pretreating furnace.

The process chamber has an entry slot for the strip by which it enters said chamber from the box which carries the strip deflecting pulley. The strip is then taken through "reversed" wiper means contacting the strip under a very slight pressure. The purpose of these wiper means is to prevent any excess zinc rolled off the strip by rollers arranged after the wiper means, from falling down onto the strip deflecting pulley. The major part of the zinc removed from the strip by the rollers will run down onto the top faces of the wiper means. If part of the zinc runs through the slot of the wiper means, it will, by capillary action, run down the bottom face of the wiper means. As a result thereof, the rolled-off zinc will drop to the bottom of the process chamber from where it is returned to the zinc melting and de-oxidizing oven.

The molten zinc is supplied to the zinc application device from a zinc melting oven by means of a zinc pump. Excess molten zinc which is partly removed by the rollers and finally by subsequent hot blasting, drops to the bottom of the process chamber, from where it is returned, by gravity, to the zinc melting oven for further recirculation. Should any zinc oxide have been formed on the way from the process chamber, it will be de-oxidized to metallic zinc by the floating layer of de-oxidizing agent provided on the molten zinc surface of the oven.

The zinc applying means are provided between the reversed wiper means and the roller which serve to remove most of the excess zinc from the coated strip. Thereafter, the zinc coated strip is subjected to a hot blast of a gas which removes the remainder of the excess zinc. Again if no aluminum is added to the spelter, this hot blast does not have to be non-oxidizing. The coated strip passes then from the coating chamber through a narrow slot into the surrounding atmosphere, where it undergoes rapid cooling, i.e. quenching.

The combination of said guiding rollers and the immediate quenching of the strip coating at the strip exit from the chamber permits to considerably reduce the non-guided portion of the coated strip, rendering it substantially rigid, when it arrives at the hot blasting zone. Said guiding distance is measured vertically from the bite of said rollers and up to the point where, after being spray cooled, the zinc coating has become sufficiently hard to be mechanically guided by a pulley. Thereby, the strip is kept in a substantially rigid condition so as to ensure optimum performance of the hot blast. As a result thereof, the nozzles (or the slot) of the hot blasting unit can be placed much nearer to the strip surface than is possible without the use of the rollers and the rapid cooling means. This fact, in its turn, will result in a lower hot gas pressure and a lower gas consumption.

The resulting "stability" of the travelling strip in the coating chamber also permits to provide narrowing of the strip exit slot therefrom. A narrow exit slot, of course, allows to operate under a lower pressure of the non-oxidizing atmosphere in the coating chamber than heretofore possible. As a result thereof, the gas consumption of the galvanizing unit is considerably reduced.

The short exposure of the metal of the strip to the molten zinc and the almost immediate cooling of the zinc coating which takes place when the strip exits from the coating chamber render it possible to reduce considerably or to even completely eliminate the addition of aluminum to the spelter.

When aluminum is added to the spelter, the hot blast must be of a non-oxidizing composition or it must even be, for practical reasons, slightly deoxidizing so as not to cause oxidation of the added aluminum. However, when proceeding according to the present invention, the time of contact of the molten zinc with the strip is so short that addition of aluminum can be completely avoided. Therefore, superheated steam can be used for hot blasting because it does not oxidize molten zinc. Such superheated steam is much cheaper and simpler to produce than a non-oxidizing gas blast. Besides, should air be mixed with the steam and should some zinc oxide be formed, the de-oxidizing effect of the protective layer provided on the zinc surface in the zinc melting oven will reduce any formed oxide to metallic zinc. It is, of course, not possible to reduce the aluminum oxide portion of conventional top-dross by the de-oxidizing layer in the zinc melting oven.

In view of the fact that the coating of the metallic article can consist of pure zinc when proceeding according to the continuous hot coating process of the present invention, the resulting coating has the best imaginable anti-corrosive properties. Since the coating consists of pure metal, no galvanic effects between the basic zinc and its alloying elements are encountered.

Another advantage of the process according to the present invention is that the coating of pure zinc is more flexible and ductile than that of its alloys, including aluminum-zinc alloys. Thus the pure zinc coated strip can better be subjected to stamping and/or drawing working than products galvanized in the conventional manner. Lack of aluminum addition to the spelter avoids the unpleasant feature of "conventional" continuous galvanizing, namely the formation of "WHITE RUST" which is especially critical in damp atmospheres and which is a direct result of the aluminum added to the D spelter. Chromate surface treatment baths, or similar, are used to prevent the formation of white rust. Obviously the present process does not need any such extra treatment.

While the process according to the present invention has been described hereinabove with respect to galvanizing ferrous articles such as steel strips, it is, of course, also possible to use said process for applying coatings of other metals to metallic articles. Thus the process can be used, for instance, for coating articles and especially strip with aluminum, tin or tern alloy, or others. Of course, other metallic articles than ferrous articles such as copper strips can also be metallized by the process of the present invention.

Likewise, instead of pouring the molten metal through nozzles upon the metallic article or strip or applying it to the article or strip by means, for instance, it can also be applied thereto by other means, for instance, by forcing a stream of molten zinc by gravity upon the strip or by any other suitable means. In principle, the molten coating metal is applied to the metallic article by projecting or gently pouring it thereon in the form of a continuous stream.

As mentioned, one of the advantages of using spelter without aluminum alloying is the possibility of using cheap steam for the hot blast instead of more expensive non-oxidizing gas, because steam does not oxidize molten zinc (but does, very energetically, aluminum). However, it is not possible to have steam from the hot blast mix with the stationary gas of the pretreating chamber of the furnace. A gas separating means must be provided to separate the hot blast from the gas in the pretreating chamber. A vertical separator is located either before the zinc headers and the spreader rolls or at the centerlines plane of these rolls. In the first case the not yet coated strip is exposed to the steam atmosphere which is oxidizing to steel; but, for conditions of modern, high strip speed galvanizing this exposure is of so short a duration that this oxidation is not harmful. For lower speed galvanizing, however, the duration is longer and the gas-steam separation wall can be placed over and under the spreader rolls, so that no "raw" strip is exposed to the steam atmosphere.

The bottom seal of the lower roll can be obtained by submerging a segment of said roll into a bath of molten coating metal. This bath is also used to collect the molten coating metal excess which has been removed from the strip by the spreader rolls. Conventional sealing and wear elements known to the men skilled in the art are to be used at the split of the "wall" for the high speed type of unit and on the upper roll of the described low speed type of coating unit. Typical examples will be given in connection with the drawings.

In any case, in order to prevent any steam from getting into the neutral gas zone of the unit by leaks, it is suggested to keep the pressure in the neutral gas zone somewhat higher than in the steam zone.

Pursuing the idea of reducing the time during which the the steel strip is being attacked by the molten zinc, it is being suggested to use the hot blast gas, (in our case—steam), at a temperature somewhat below the melting temperature of zinc, thus giving the coating a "pre-chill", thus hastening its solidification, i.e., favoring one of the main features of the invention.

While the final blasting off of the molten coating metal by gas or steam at a temperature above that of the melting of zinc will produce fine droplets of that metal which, in certain conditions, will have a tendency to stick to the walls of the coating chamber, building up an ever-thickening metal layer, said blasting off by gas or steam at a temperature lower than that of the melting temperature of zinc will have tendency to solidify said droplets into a substance similar to granulated sugar which will not stick to the walls of the coating chamber, but fall into the channel which conducts the molten zinc just removed from the strip by the spreader rolls back to the general zinc melting oven.

As will be explained in greater detail in what follows, the invention also provides the possibility of applying one or more molten coating metal streams onto the strip moving in a substantially horizontal position slightly sloping down in the direction of the movement of the material to be coated.

One of the advantages of said arrangement is that one can eliminate the "reversed wiper means" which are necessary if the strip is being coated running vertically.

BRIEF DESCRIPTION OF THE DRAWINGS

The above and other objects, advantages, and uses of the present invention will become apparent from a reading of the following specification and claims taken in conjunction with the attached drawings which form a part of the specification and wherein:

FIG. 8 is a cross-sectional view of a dipless coating apparatus enabling the use of steam for the hot blast, of a type recommended for high strip velocities;

FIG. 9 is a cross-sectional view of a dipless coating apparatus enabling the use of steam for the hot blast, of a type recommended for lower strip velocities; and FIG. 10 shows details of the gas tight seals, applicable to both, the high speed and low speed, systems and is a section according to X-Y of FIGS. 8 and 9.

Like numerals in said drawings indicate like parts of the equipment.

DESCRIPTION OF THE PREFERRED EMBODIMENT

Figure 1:
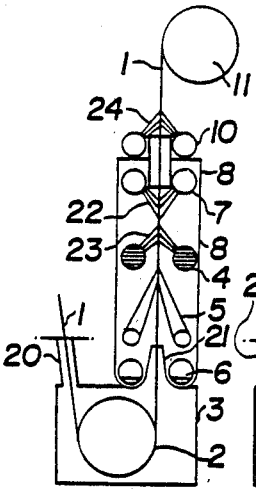
FIG. 1 is a vertical cross-sectional view of a dipless coating apparatus in which molten zinc is applied to the rising strip which is then hot-blasted and quenched.

In said drawings, FIG. 1 demonstrates the principal features of the present invention.

In said FIG. 1 strip 1 to be coated is passed from the pretreating furnace (not shown) through snout 20 into substantially gas-tight chamber 3 carrying strip deflecting pulley 2. Said pulley 2 deflects strip 1 so that it is conducted vertically upwardly into coating and processing chamber 8 containing and enclosing the various elements of the galvanizing process of the present invention. Strip 1 passes through orifice-like opening 21 into said chamber 8 and is then contacted by the pair of wipers 5. Strip 1 is then contacted by a continuous stream of molten zinc 23 dispensed through headers 4 with nozzle-like openings. Excess zinc drops onto wipers 5 and is deflected from the strip and collected in return conduit 6 from which the zinc is returned into the zinc melting and regenerating oven (not shown). The remainder of excess zinc on the zinc coated strip is removed therefrom by the hot gas blast 22 supplied through hot gas blast header 7. The zinc-coated strip 1 from which excess zinc has been removed passes through strip exit slot 9 of coating chamber 8 and is conducted to stabilizing pulley 11 which in cooperation with strip deflecting pulley 2 stabilize movement of the strip on traveling through coating chamber 8. Immediately after coated strip 1 has left said chamber 8 through exit slot 9, it is rapidly cooled by exposure to a spray of a cooling fluid 24 sprayed thereon by means of header 10. When operating as shown in FIG. 1, the strip is passed successively through reverse wipers 5, a steam of molten zinc 23 applied by means of header 4, and hot gas blast 22 applied by means of header 7, all of them enclosed in processing chamber 8, and is then rapidly cooled by fluid spray 24.

Figure 2:
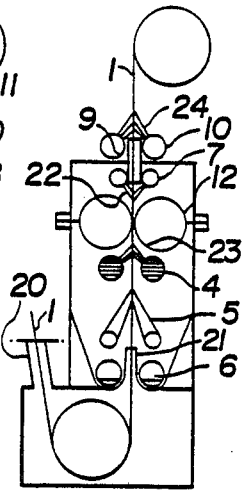
FIG. 2 is a cross-sectional view of a similar dipless coating apparatus in which strip movement stabilizing and excess zinc removing rollers are provided between the zinc applying means and the hot-blasting means.

The coating apparatus as ilustrated in FIG. 2 differs from that of FIG. 1 by providing between the application of the molten zinc stream 23 and the hot gas blast 22, roller means 12 which remove the major part of excess zinc from coated strip 1 passing therethrough. Said roller means 12 aid in further stabilizing the movement of strip 1 on its travel through coating chamber 8.

Figure 3:
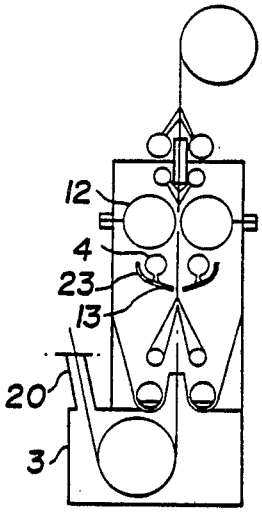
FIG. 3 is a cross-sectional view of a similar dipless coating apparatus in which the molten zinc is applied to the strip by means of a troughlike distributing means.

In FIG. 3 a modification of the means for applying a continuous stream of molten zinc to strip 1 is illustrated while otherwise the apparatus is the same as shown in FIG. 2. According to this modification the molten zinc 23 is poured from header 4 onto deflecting and distributing spreader 13 which applies it to strip 1.

Figure 4:
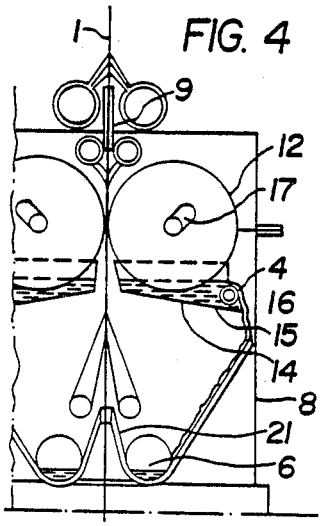
FIG. 4 is a cross-sectional view of a dipless coating apparatus in which the molten zinc is applied to the strip by means of the stabilizing rollers which are partly immersed in an overflowing dipping bath.

Another means of applying molten zinc to strip 1 is illustrated in FIG. 4. According to said modification the molten zinc 15 is supplied to pans 14 by means of header 4. Rollers 12, as shown, dip into said pans 14 and carry along the molten zinc for application to strip 1. The rollers 12 are provided with elongated and inclined slots 17 which carry a journal of the stabilizing rollers 12 and thus assist in exerting pressure between the rollers 12 but still permit shifting of the rollers so that a strip threading tool can be passed therebetween. Dipping pans 14 are provided with a molten zinc overflow 16 allowing the molten zinc 15 in the pans 14 to overflow onto and along the walls of coating chamber 8 and downwardly into the return conduit 6 from where it is returned to the zinc melting oven (not shown).

Figure 5:
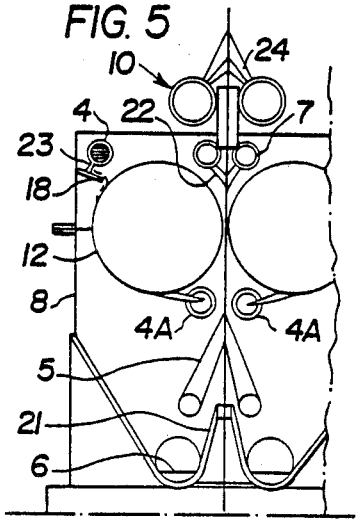
FIG. 5 is a cross-sectional view of a dipless coating apparatus similar to the apparatus of FIG. 4 in which the molten zinc is poured on the rollers from a header and is applied to the strip by said rollers covered with the molten zinc.

Another modification of the means for applying molten zinc to the strip 1 is illustrated in FIG. 5, whereby the molten zinc stream 23 is supplied through header 4 to deflector-distributor plate 18 which allows even spreading of the molten zinc over the surfaces of rollers 12 which apply ("print") the molten zinc onto the surface of strip 1.

A variation of this embodiment consists of spraying the rollers 12 in an anti-rotational direction from headers 4-A preferably located close to the rollers and to the mounting strip.

It will be noted that in the apparatus illustrated by FIGS. 2 to 5, inclusive, in which strip stabilizing rollers 12 are used, the exit slots 9 can be made much more narrower than in the apparatus illustrated by FIG. 1, where no stabilizing rollers are used. Since movement of the strip is greatly enhanced by providing rollers 12 as shown in FIGS. 2 to 5, the efficiency of the hot blast is considerably improved, so that a reduced hot blast gas consumption is achieved. Consequently, the hot gas blast headers 7 can be made smaller than the headers 7 of FIG. 1, which shows no stabilizing rollers.

As stated above, the claimed process permits, according to another embodiment of the present invention, to conduct the hot metallic article to pass substantially horizontally through coating chamber 3. Thus, the procedure permits to eliminate the wiper means 5 described hereinabove.

Figure 6:
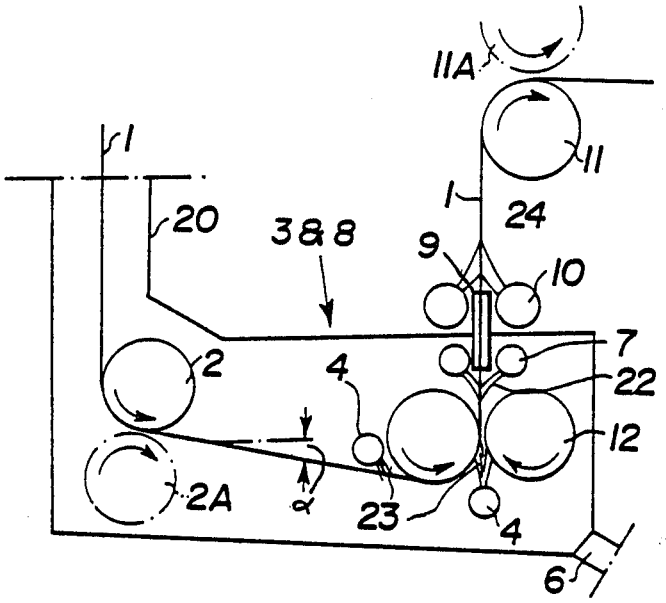
FIG. 6 is a cross-sectional view of a dipless coating apparatus in which the strip is passed through the coating chamber in substantially horizontal direction and, after coating, is deflected upwardly for subsequent treatment.

FIG. 6 illustrates in cross-sectional view this procedure. In said FIG. 6 strip 1 to be coated is passed from the pretreating furnace into chamber 3 which carries the strip deflecting pulleys 2 and 2*a*. Pulley 2*a* may even be omitted. Strip 1 passes then substantially horizontally, preferably at a small angle downwardly, toward rollers 12 which remove the major part of excess zinc from coated strip 1. Said rollers preferably deflect the coated strip upwardly to the hot blast means.

While passing from deflecting pulleys 2 and 2*a* through coating chamber 3, the strip is contacted by a continuous stream of molten zinc 23 dispensed through headers 4 with nozzle-like openings. Preferably the upper header is provided in the substantially horizontal part of the strip while the lower header is provided underneath rollers 12. Otherwise the procedure is the same as described hereinabove, except that the wiper or deflecting means 5 are omitted.

Figure 7:
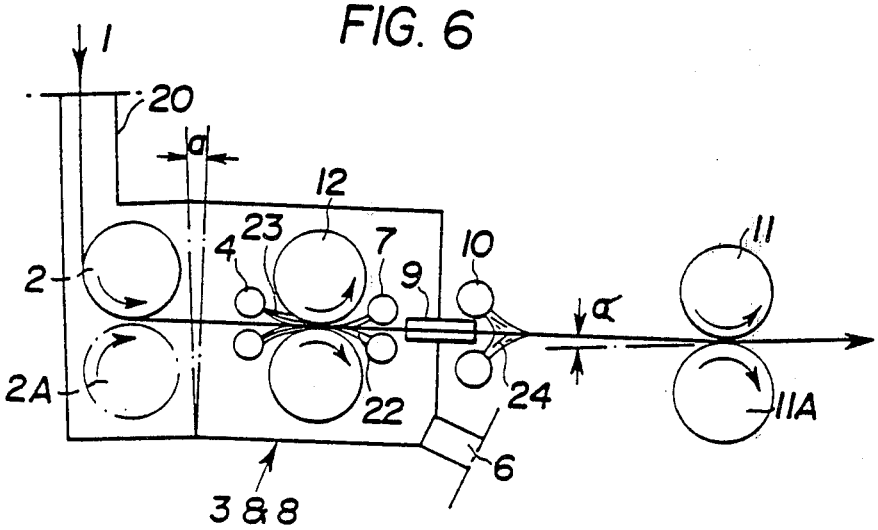
FIG. 7 is a cross-sectional view of a dipless coating apparatus similar to that of FIG. 6 in which the strip is passed substantially horizontally through the coating chamber and also through the subsequent treatment systems.

FIG. 7 illustrates a further embodiment of the present invention whereby the strip after coating is horizontally conveyed past the hot gas blast header 7 through strip exit slot 9 of coating chamber 3 to stabilizing pulleys 11 and 11*a*. Between exit slot 9 and stabilizing pulleys 11 and 11*a* there are arranged two headers 24 spraying cooling fluid upon the coated strip 1 so as to rapidly cool the same.

Coating chambers 3 in FIGS. 6 and 7 are provided with outlet 6 for excess molten coating metal. The horizontal strip can actually be flooded with cooling fluid such as water. The angle of downward inclination of strip 1 traveling through coating chamber 3 is indicated by 2. FIG. 8 depicts the separator wall (30), having an upper section (31) and a lower section (32). The upper edge (33) of lower section (32) may be lined with a wear strip (34), made of relatively soft material like asbestos, adjustable vertically to compensate for wear. The passing strip to be galvanized slightly presses onto (33). The upper part (31) is slidable in the vertical direction and presses onto strip (1), by its weight, and thereby onto the wear strip (34) of (32). It is shown as a solid board maintained in position by appropriate guides on the chamber walls and ceiling extension (35). As will be described in greater detail in FIG. 10, the upper part (31) of wall (30) is pressed against a machined portion (42) of the side wall of the chamber (3) and of the ceiling extension (35). The chamber is split and screwed together by appropriate flanges (36) on the substantially vertical planes passing through the center lines of the deflecting pulleys (2 and 2A) and spreading pinch rolls (12 and 12A). The whole system (chamber, rolls, headers, etc.) is inclined somewhat from the horizontal plane to prevent the molten zinc from flowing "upstream" in relation to the movement of the strip (1). A bent part (37), forming a "rigidity rib" of the lower section (32), also forms a guide for the strip during the threading of the furnace-proper (not shown) and of the metallizing chamber (3). The pinch rolls (11 and 11A) catch the quenched strip and deflect it, horizontally or vertically for further processing.

FIG. 9 shows a further embodiment having the separator "on" the spreading pinch rolls (12 and 12A) of the metallizing chamber. This chamber is similarly tilted at an angle $\alpha$ and is split on two planes, defined by the upper and the lower deflector and spreader pinch rolls, and held together by screwing together flanges (38). While the sealing of the upper spreader pinch roll to the chamber wall 3 is achieved by means similar to those of the wall of FIG. 8, that of the lower roll is obtained by dipping it into a pure zinc bath (39) contained in a tank (40). Zinc coming from the headers (4) and partly removed by the spreader pinch rolls, as well as that removed by the hot spray, falls into said tank (40), overflows its lower edge (48) and is conducted into the zinc dump (not shown) by pipe (6).

FIG. 10 shows one embodiment of the seals of the separating walls of the metallizing chamber against the side and upper panels of the metallizing chamber. The upper wall (31) has a smoothed edge (41) in contact with a machined face (42) of the side panel (43) of chamber (3). Spring (44) forces wall (31) against face (42), insuring gas tightness. The smoothed edge (47) of the wall (31) is sealed off by strip (45), the latter being pressed towards wall (31) by spring (46).

One of ordinary skill in the art can apply the separator wall concept to the embodiments shown in FIGS. 1 through 7 as well.

It will be noted that FIGS. 4 and 5 are applicable to spreader rolls made of "zinc wettable" materials, like iron or steel. The rest of the figures may be applicable to "zinc-unwettable" materials, like silicon-carbon, ceramic or composite materials.

I claim:

1. Apparatus for providing a metallic article with a metal coating, said apparatus comprising:

(a) a coating chamber having an entrance opening for the metallic article to be coated, and an exit opening for the metal coated article, (b) means within and enclosed by said chamber for applying a continuous stream of molten metal to the metallic article to be coated for a very short period of time so as to uniformly and evenly distribute the coating metal over the surface of the hot metallic article so as to coat the same, (c) means downstream of said molten metal applying means for subjecting the coated metallic article to a hot gas blast comprising steam or other gases which would otherwise oxidize any aluminum contained in the molten coating metal except for the rapidity of the coating step, so as to remove substantially completely excess coating metal from the coated article, and (d) means exterior to the exit opening of said coating chamber for rapidly cooling the metal coated article, prior to further handling.

2. The apparatus of claim 1, further including reverse wiper means opposed to each other and positioned in advance of the means for applying the coating metal to the metallic article, said wiper means serving to deflect excess coating metal from said metallic article as said article passes therebetween.

3. The apparatus of claims 1 or 2, wherein said means for applying a continuous stream of molten coating metal to the metallic article comprise headers provided with nozzles discharging said continuous stream of coating metal uniformly and evenly distributed upon the surface of the metallic article.

4. The apparatus of claims 1 or 2 wherein said means for applying a continous stream of coating metal to the metallic article comprise headers to which the molten coating metal is delivered, and deflecting and distributing spreaders which receive molten metal from said headers and cause the molten metal to evenly and uniformly contact the metallic article to be metal coated.

5. The apparatus of claim 1, wherein said means for applying a continuous stream of molten coating metal to the metallic article comprise rollers, said rollers dipping into pans arranged thereunder and supplied with molten coating metal, said rollers, on rotation, carrying along molten coating metal and causing said metal to uniformly and evenly contact the metallic article passing between said rollers towards the hot gas blast.

6. The apparatus of claim 1, wherein said means for applying a continuous stream of molten coating metal to the metallic article comprise rollers, said rollers being supplied with molten coating metal by means of headers and deflector-distributor plates positioned below said headers; said rollers, on rotation, carrying along molten coating metal and causing said metal to uniformly and evenly contact the metallic article passing between said rollers towards the hot gas blast.

7. The apparatus of claims 1 or 2 further including opposed rollers positioned between said molten metal applying means and said hot gas blasting means; said rollers, on rotation, removing excess coating metal from the coated metallic article passing through the same.

8. The apparatus of claim 1, further including means for separating the zone in which the application of the molten coating metal is performed from the zone of the hot steam gas blast, said separating means preventing the atmosphere of the coating zone to mix with that of the blasting zone.

9. The apparatus of claim 8, further including spreading rollers, and wherein said separating means is located in or close to the plane of the spreading rollers.

10. The apparatus of claim 9, wherein said spreading rollers include a lower roll which is sealed by dipping said roll in an overflowing bath of molten coating metal.

11. The apparatus of claim 1 further including a separating wall located in a plane immediately preceding the metal coating means, the arrangement of said separating wall and said coating means being such that the strip not yet coated is subjected to a steam atmosphere or atmosphere of said other gases produced by said hot gas blast applying means for less than a second.

* * * * *